US007584711B1

(12) United States Patent
Healy

(10) Patent No.: US 7,584,711 B1
(45) Date of Patent: Sep. 8, 2009

(54) TOWABLE UNDERWATER CRAFT

(75) Inventor: Eric W. Healy, Bend, OR (US)

(73) Assignee: Eric William Healy, Bend, OR (US)

( * ) Notice: Subject to any disclaimer, the term of this patent is extended or adjusted under 35 U.S.C. 154(b) by 0 days.

(21) Appl. No.: 12/074,323

(22) Filed: Mar. 3, 2008

(51) Int. Cl.
*B63C 11/46* (2006.01)

(52) U.S. Cl. ..... 114/315

(58) Field of Classification Search ..... 114/244, 114/245, 315, 274
See application file for complete search history.

(56) References Cited

U.S. PATENT DOCUMENTS

| | | | | |
|---|---|---|---|---|
| 3,255,723 | A * | 6/1966 | Teetor | 114/245 |
| 3,261,318 | A * | 7/1966 | Jones et al. | 114/245 |
| 3,467,345 | A * | 9/1969 | Windecker | 244/105 |
| 3,931,777 | A | 1/1976 | Colgan | |
| 4,149,483 | A | 4/1979 | Scott | |
| 4,361,103 | A | 11/1982 | Willat | |
| 4,624,207 | A | 11/1986 | King | |
| 5,134,955 | A | 8/1992 | Manfield | |
| 5,178,090 | A | 1/1993 | Carter | |
| 5,605,111 | A | 2/1997 | Culpepper | |
| 6,145,462 | A | 11/2000 | Aquino | |
| 6,561,116 | B2 | 5/2003 | Linjawi | |
| 6,612,254 | B1 | 9/2003 | Arthur | |
| 6,615,761 | B2 * | 9/2003 | Wyman | 114/315 |

* cited by examiner

*Primary Examiner*—Ed Swinehart

(57) ABSTRACT

A towable underwater craft includes a main body contoured to support the rider in the prone position, a contoured leading edge, left and right arm guards, left and right independently actuated hydrofoils and a tow rope. The majority of the craft is constructed from a foam core and a fiber-reinforced polymer exterior to provide the required buoyancy and strength. The tow rope is attached at one end to a powered water craft and to the craft at the opposite end. The pitch of the left and right hydrofoils are controlled independently by the rider. This actuation controls both the depth and roll of the craft enabling the rider to fully control the craft below the surface of the water while being towed.

9 Claims, 5 Drawing Sheets

TOWABLE UNDERWATER CRAFT

FIELD OF THE INVENTION

This invention relates to water sport devices designed to be towed behind a powered water craft, specifically to an improved device that is capable of submerging below the surface of the water with depth and roll controlled by a rider.

BACKGROUND OF THE INVENTION

There are many different kinds of water sport devices designed to be towed behind a powered watercraft, such as a power boat. The most popular of devices have been strictly for use on the surface of the water. These devices include water skis, kneeboards and wakeboards and have been widely successful. Their success suggests potential for a devise that can travel above and below the surface while being controlled by the rider.

Another category of water sport devices are designed to be submersible, and several types of submergible devices have been proposed—for example, U.S. Pat. Nos. 6,612,254 (2002) to Arthur, 6,561,116 (2001) to Linjawi, 6145462 (1999) to Aquino, 5,605,111 (1995) to Culpepper, 5,178,090 (1991) to Carter and 5,134,955 (1991) to Manfield all describe a variety of devices that are capable of being submerged.

The device described in U.S. Pat. No. 6,612,254 is a towable underwater "kite" that has independently operated symmetrical wings positioned near the leading and trailing edges of the main body. The main body of the kite is defined by parallel support members (e.g., plastic tubes) that are interconnected with transverse struts on their ends. This defines a belly board on which the user lies in a prone position, horizontal in operation. The user operates the forward wings with his or her hands, and the rear wings with his or her feet.

The device described in U.S. Pat. No. 6,561,116 is a towable sub-aqua device that has two independently operated maneuvering planes positioned on opposite lateral sides. The main body of the device is defined by support member comprises a U-shaped bar. Each maneuvering plane has a protruding bar that is pivotally attached to the main U-shaped bar. Each protruding bar is bent 90 degrees at the inboard end making a handle.

The device described in U.S. Pat. No. 6,145,462 is a towable diver aid that has a support platform pivotally mounted within a rigid linking tubular frame. The diver is positioned on the support platform in the prone position and controls the depth by rotating the platform relative to the tubular frame.

The device described in U.S. Pat. No. 5,178,090 is an underwater diving plane that has a triangular aluminum frame. The device has a detachable transverse axle which is pivotally connected to the main frame, having two ends and two planes fixedly attached to the axle giving the diver depth control.

While the foregoing devices represent improvements in the field of technology, they also have certain disadvantages. For example, the devices described above produce lift in the downward direction when the rider directs the hydrofoils down. Buoyancy is critical for the craft to perform optimally. The majority of the prior art uses a metal tubular frame which does not provide this required buoyancy. This is a major disadvantage in that, the craft will not rise to the surface on it's own in the event that the rider comes off or becomes incapacitated.

Further, the majority of the known prior art devices use a metal or plastic tubular frame. This limits the craft to a very basic design. It does not allow the craft to be contoured around the rider's body. This is required to support the rider in the prone position. In addition, it is required to deflect the oncoming water around the rider and provide a hydrodynamic shape. Directing the oncoming water around the rider reduces the drag felt by the rider. This allows for higher speeds and more maneuverability. The lack of proper contouring by the prior art also makes the rider vulnerable to the oncoming obstacles and debris.

There is an ongoing need and opportunity therefore for improved submersible watercraft designed to be towed behind another craft.

Accordingly, several objects and advantages of my invention are:

(a) to provide a craft that is constructed of modern composite materials consisting of a sufficiently buoyant foam core and fiber reinforced polymer exterior allowing for sufficient buoyancy to counter the downward lift and provide depth control.

(b) to provide a craft that is constructed of modern composite materials consisting of a sufficiently buoyant foam core and a fiber reinforced polymer exterior allowing the craft to automatically come to the surface in the event that the rider comes off or becomes incapacitated.

(c) to provide a craft that is constructed of modern composite materials consisting of a foam core and a sufficiently ridged fiber reinforced polymer exterior allowing for complex contours that house the rider in the prone position.

(d) to provide a craft that is constructed of modern composite materials consisting of a foam core and a sufficiently ridged fiber reinforced polymer exterior allowing for complex contours that deflect the oncoming water around the rider while providing low drag, increased speeds and better maneuverability.

(e) to provide a craft that is constructed of modern composite materials consisting of a foam core and a sufficiently ridged fiber reinforced polymer exterior allowing for complex contours that wrap around the rider's hands, forearms, upper torso and shoulders to provide protection to the rider from oncoming obstacles and debris.

Other objects and advantages are to provide a craft that has two independently actuated hydrofoils where each hydrofoil is symmetric about its cord so that in its natural position, or when there is no control input from the rider, it produces no lift whereby allowing for the built in buoyancy to raise the craft to the surface. It is essential to the rider's safety that the craft raise to the surface without any control input. Further objects and advantages are to provide rapid ascent capabilities controlled by the rider. This is accomplished by placing the hydrofoils ahead of the point of pitch rotation on the craft, or the point where the tow line attaches, allowing the entire craft to pitch up when the hydrofoils are deflected up causing an increased ascent and further increasing the safety. Still further objects and advantages will become apparent from a consideration of the ensuing description and drawings.

In accordance with the present invention a towable under water craft comprising a main body contoured to a rider's upper torso, two independently actuated hydrofoils for controlling depth and roll and a tow line for attaching the craft to a powered water craft.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE ILLUSTRATED EMBODIMENTS

Figure 1:
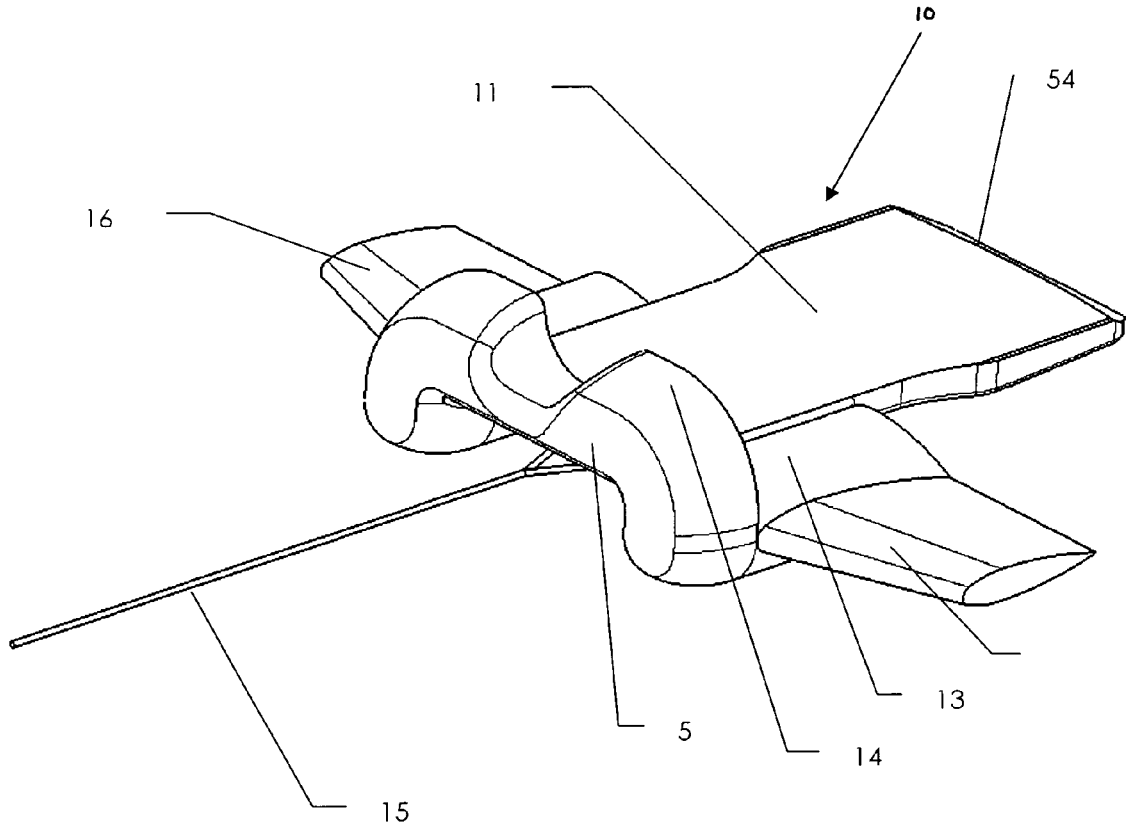
FIG. 1 is a front, upper perspective view of the submersible craft according to the present invention, showing the entire craft. A rider lies on the craft in the prone position.

A first preferred embodiment of the towable underwater craft 10 of the present invention is illustrated in FIGS. 1 through 5. FIG. 1 shows the upper side of the craft. It will be appreciated that a rider lies on the craft in the prone position with his or her arms positioned in the left 13 and right 17 arm guards. The rider's head and shoulders are positioned in and behind the contoured leading edge 14. The main body 11 is defined by a contoured central portion that is configured for accommodating a rider's upper torso, a leading edge 14 and a pair of arm guards, namely, a left arm guard 13 and a right arm guard 17. The left 12 and right 16 hydrofoils are located on their respective sides of the craft and butt up against the left 13 and right 17 arm guards. The tow rope 15 is attached to a powered water craft at one end (not shown) and attached to the craft on the other end.

As detailed herein, the craft 10 defines a platform on which the rider lies in a prone position. The craft has a leading edge identified generally with reference number 52, and a trailing edge given reference number 54. When a rider is lying prone on craft 10, the trailing edge 52 of craft 10 is positioned near the rider's stomach area—the position of the trailing edge 52 relative to the rider's body depending of course upon the height of the rider. For ease of reference, relative directional terms used herein are used with reference to the horizontal plane defined by the water's surface. Thus, "upper" refers to the direction toward the surface of the water when the craft 10 is submerged; "lower" would thus refer to the opposite direction. "Forward" identifies the direction in which the craft is normally towed, and rearward is thus the opposite direction. The "leading edge" of craft 10 is that edge of the craft at the forward end that is presented to the water as the craft is towed, and the trailing edge is the edge at the rear of the craft.

Figure 2:
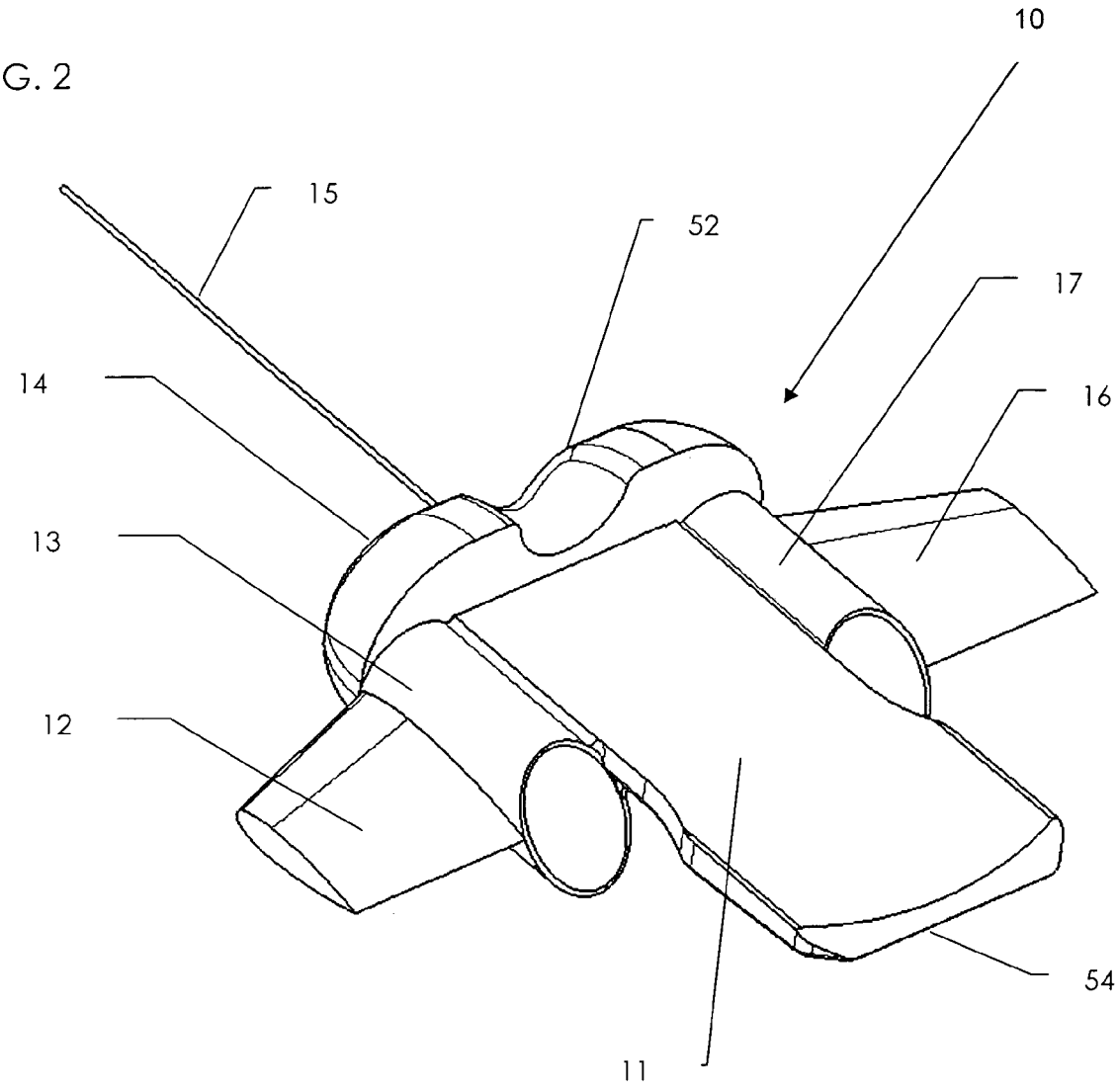
FIG. 2 is a rear, upper perspective view of the craft shown in FIG. 1, illustrating the entire craft.
Figure 3:
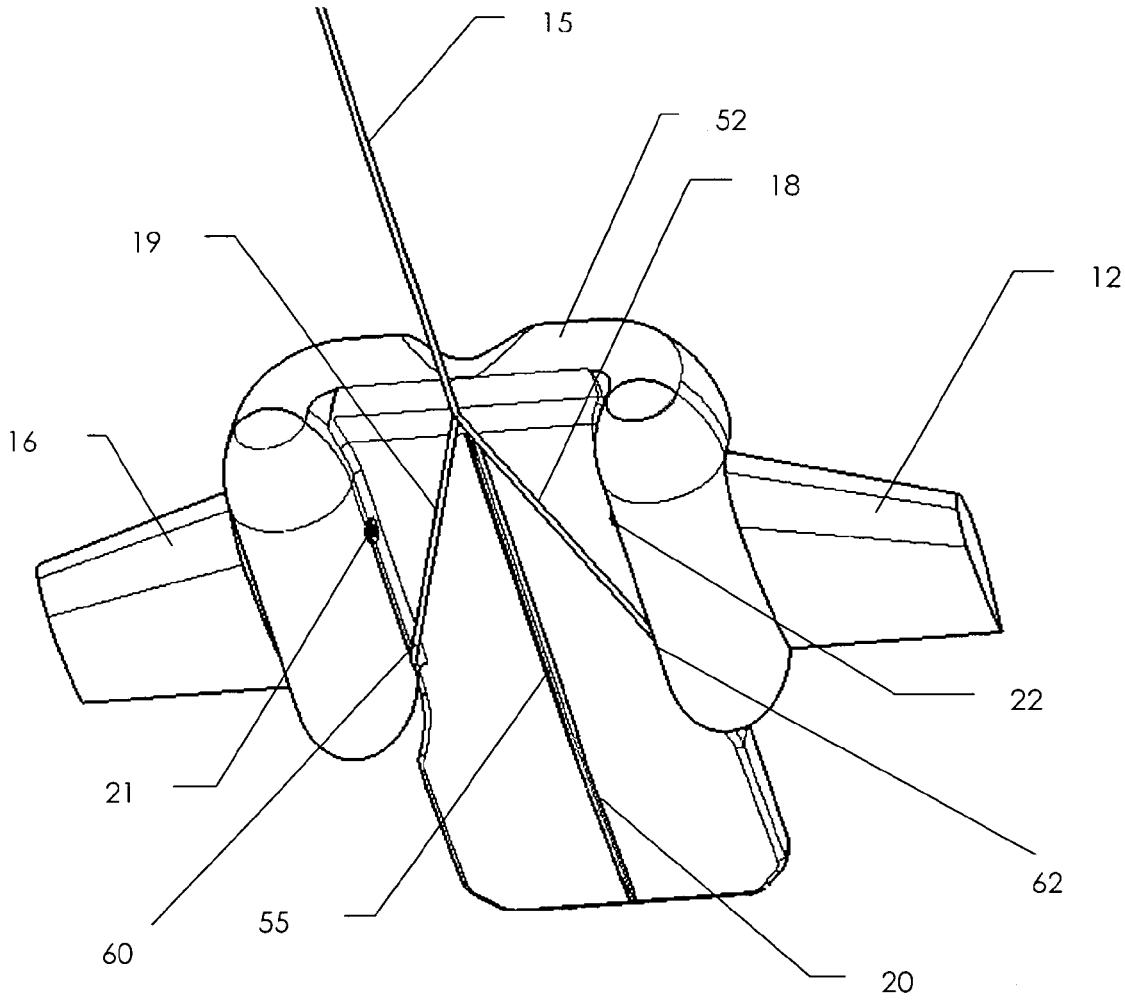
FIG. 3 is a front, lower perspective view of the craft illustrated in FIG. 1, showing the entire craft from below and illustrating where the tow rope is attached.

With reference to FIGS. 2 and 3, the contour of the main body 11 is visible in as well as the opening of the left 13 and right 17 arm guards. The main body 11, left 13 and right 17 arm guards, the contoured leading edge 14 and the fin 20 are all one continuous piece constructed of a foam core and fiber reinforced polymer exterior. The fin follows the longitudinal centerline CL through the main body. The left 12 and right 16 hydrofoils are each an additional part also constructed of foam and fiber-reinforced polymer. The left 13 and right 17 arm guards are fully contoured around the rider's hands and forearms providing protection from oncoming debris and further reducing the drag on the craft 10. FIG. 3 shows the under side of the craft. Specifically the fin 20, the left 18 and right 19 forked tow rope and the right 21 and left 22 end cap. In addition, the main body 11 attachment point locations of the left 18 and right 19 forked tow ropes are shown. They are attached via two eye bolts 60, 62 that each protrude through the inside wall their respective left 13 and right 17 arm guards The center of pressure 55 is the point on a body where the sum total of the hydrodynamic pressure field acts, causing a force and no moment about that point.

Figure 4:
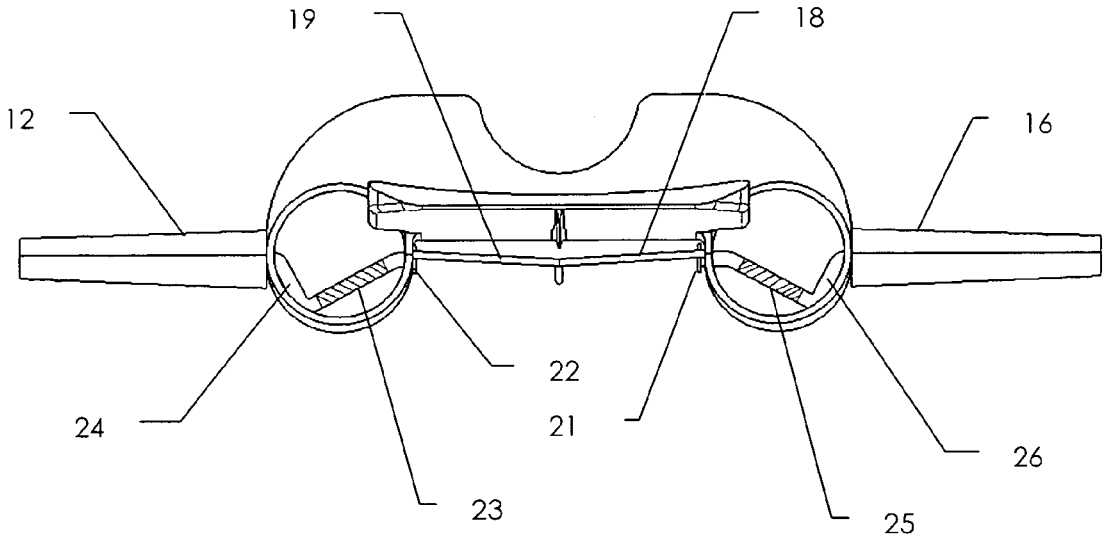
FIG. 4 is a rear elevation view of the craft according to the present invention showing the entire craft and illustrating how each shaft from the hydrofoils passes through each arm guard.

FIG. 4 shows the craft from the rear and illustrates how the left 12 and right 16 hydrofoils attached to the left 13 and right 17 arm guards of the main body. The left 24 and right 26 shafts are coaxial and protrude through holes on both sides of the left 13 and right 17 arm guards. The shafts 25 and 26 define a shaft axis. The right 21 and left 22 end caps are welded to the left 24 and right 26 shafts so that the shafts are pivotally journaled to the main body. The right 21 and left 22 end caps and the left 24 and right 26 shafts are constructed of a stainless steel or other metals that have a coating to protect against rusting and corrosion. The left 23 and right 25 handles are made of a rubber material and slides over the left 24 and right 26 shafts to improve grip. Those of ordinary skill in the art will appreciate that there are numerous equivalent structures that may be used to pivotally attach the shafts to the main body.

Figure 5:
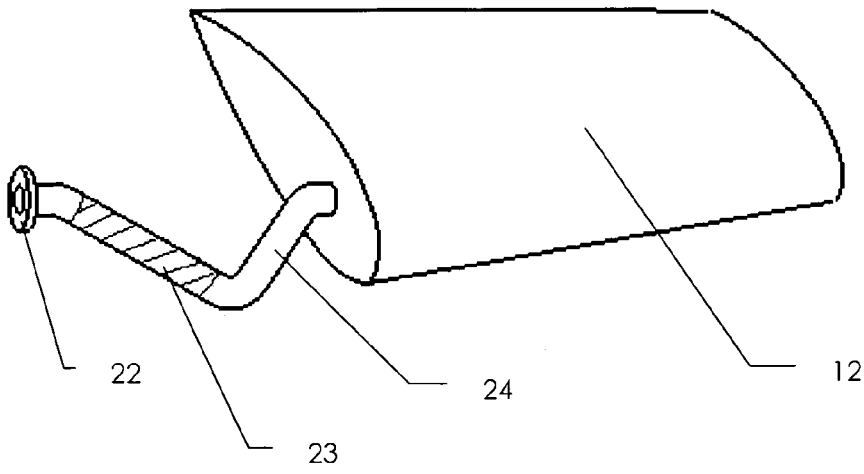
FIG. 5 is a perspective view that illustrates the left hydrofoil, shaft, handle and end cap in isolation.

FIG. 5 shows the left hydrofoil 12, left shaft 24, left handle 23 and the left end cap 22 with the rest of the craft hidden. Both the left 24 and right 26 shafts extend into their respective left 12 and right 16 hydrofoils and are bonded so that the hydrofoils cannot rotate relative to the shafts.

Operation of Craft 10

The manner of using the towable under water craft is similar to the use of current towable water sport devices such as a wakeboard or water skis in that it is to be towed behind a powered water craft by the use of the tow rope 15. It differs in that, upon the rider's discretion the craft can submerge below the surface while maintaining a significant amount of control in both depth and roll. This control comes for the left 12 and right 16 hydrofoils that are rigidly attached to the left 24 and right 26 shafts. The left 24 and right 26 shafts pivot in the left 13 and right 17 arm guards making the pitch of the left 12 and right 16 hydrofoils movable simply by rotating the left 23 and right 25 handles. Pitch stability comes from the location of the center of pressure 55. The center of pressure 55 must be located behind the point of pitch rotation, or the point where the left 18 and right 19 forked tow ropes attach to the craft 10 at eye bolts 60 and 62. With the center of pressure behind the point of pitch rotation, the craft 10 will naturally travel in the horizontal position.

FIG. 1 illustrates the purpose of the contoured leading edge 14 and the left 13 and right 17 arm guards. With a rider lying on the main body, the contoured leading edge 14 and the left 13 and right 17 arm guards help deflect the oncoming water around the rider to minimize the drag felt and to protect the rider from obstacles and debris. They also reduce the overall drag on the craft resulting in higher speeds and more maneuverability.

Figure 6:
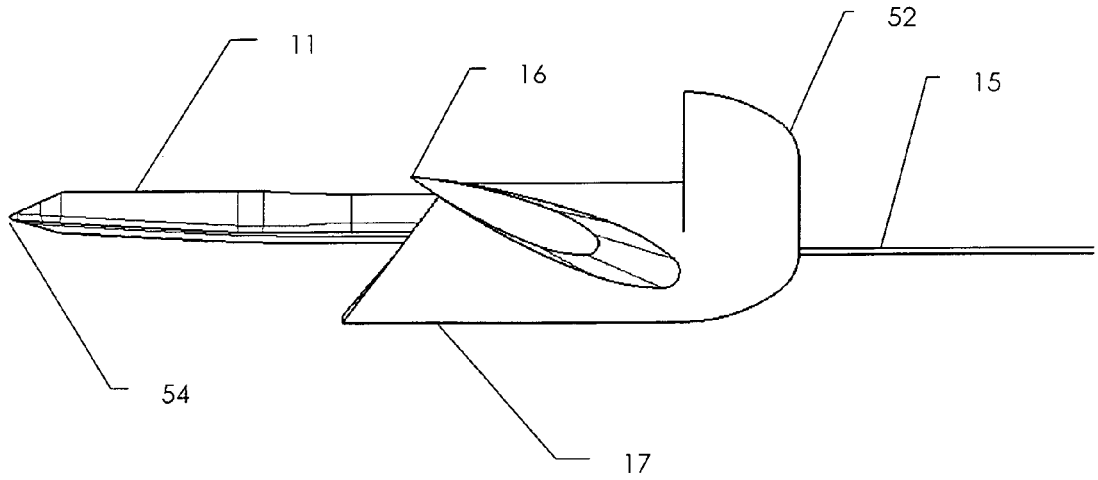
FIG. 6 is a right side elevation view of the craft according to the present invention that illustrates how the main body of the craft remains horizontal when the rider deflects the hydrofoils down in order to descend.

FIG. 6 shows the craft from the right side and illustrates how it descends. The craft descends by simply rotating both left 23 and right 25 handles downwards causing their respective left 12 and right 16 hydrofoils to pitch down.

Figure 7:
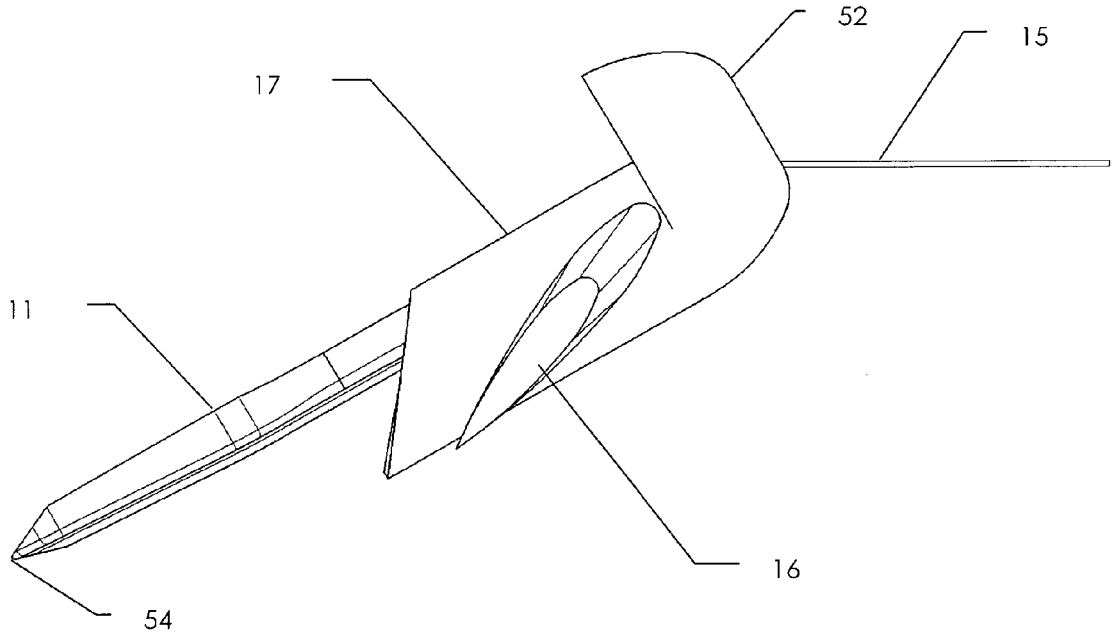
FIG. 7 is a right side elevation view similar to FIG. 6, except showing how the main body of the craft pitches up when the rider deflects the hydrofoils up in order to ascend.

FIG. 7 shows how the craft ascends. Similarly, the craft ascends by simply rotating both left 23 and right 25 handles upwards. However, for safety reasons it has the ability to ascend much quicker than it can descend. This is illustrated in FIG. 7 and is caused by the location of the attachment points of the left 18 and right 19 forked tow ropes being well behind the left 12 and right 16 hydrofoils. The location of attachment of the left 18 and right 19 forked tow ropes to the craft 10 is also the point the craft pitches about. Because this point is well behind the left 12 and right 16 hydrofoils, the entire craft pitches upwards when the left 12 and right 16 hydrofoils are pitched up making for a quicker ascent. As an additional built-in safety feature, the craft will also ascend with no control input at all. The left 12 and right 16 hydrofoils produce no lift when in their natural position, or with no control input. At this point the inherent buoyancy of the craft from the composite construction takes over and raises the craft to the surface. Roll is controlled simply by rotating the left 23 and right 25 handles in opposite directions causing the left 12 and right 16 hydrofoils to pitch in opposite directions.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. A towable submersible craft, comprising:

a main body having positive buoyancy and defining a platform configured for accommodating a rider, the main body having a hydrodynamically shaped leading edge and a trailing edge with a center of pressure between the leading and trailing edges, and opposed lateral sides;

a first hydrofoil pivotally attached to one of the opposed lateral sides of the main body with a shaft journaled to the main body at a shaft axis and a second hydrofoil pivotally attached to the opposite lateral side of the main body at a shaft journaled to the main body coaxially with the shaft axis, each hydrofoil independently pivotal about the shaft axis relative to the main body; and a tow rope attachment on the main body rearward of the shaft axis and forward of the center of pressure, said tow rope attachment defined by a pair of attachment members, each attached to an underside of the main body near a respective one of the opposed lateral side edges.

2. The towable submersible craft according to claim 1 wherein each hydrofoil is controlled by rotation of the hydrofoil about the shaft axis and each hydrofoil includes a control handle that is housed in a forwardly closed housing.

3. The towable submersible craft according to claim 2 wherein each hydrofoil may be independently pivoted relative to said main body to allow independent pitch actuations of said hydrofoils by actuation of said control handles.

4. The towable submersible craft according to claim 1 wherein the tow rope attachment members are configured for attachment to a forked tow rope.

5. The towable submersible craft according to claim wherein the main body is composed of a reinforced polymer exterior and a foam core.

6. The towable submersible craft according to claim 1 wherein the hydrofoils are composed of a reinforced polymer exterior and a foam core.

7. A towable submersible craft, comprising:

a main body having positive buoyancy, said main body having a hydrodynamically shaped leading edge, a trailing edge, and opposed lateral side edge, said main body defining a center of pressure;

a first hydrodynamically shaped hydrofoil pivotally attached to one of the opposed lateral side edges with a shaft defining a shaft axis and a second hydrodynamically shaped hydrofoil pivotally attached to the opposite lateral side of the main body with a shaft coaxially aligned with the shaft axis, each hydrofoil independently pivotal relative to the main body; and tow rope attachment means for attaching the main body to a tow rope, said tow rope attachment means on the main body rearward of the shaft axis and defined by a pair of attachment members, each attached to an underside of the main body near one of the opposed lateral side edges and forward of the center of pressure.

8. The towable submersible craft according to claim 7 configured for attachment to a forked tow rope.

9. A hydrodynamically efficient towable underwater craft, comprising:

a main body having positive buoyancy, said main body defining a central portion configured for accommodating a rider and said main body having a leading edge, a trailing edge, and opposed later side edges, wherein a center of pressure is defined between the leading and trailing edges, said main body having a longitudinal centerline;

a first hydrofoil attached to one of the opposed lateral side edges at a shaft axis;

a second hydrofoil attached to the opposite lateral side edge at the shaft axis, each hydrofoil independently pivotal relative to the main body about the shaft axis and each hydrofoil having a control handle housed in a forwardly-closed housing;

a tow rope attachment defined by two tow rope attachment members, each attached to an underside of the main body near one of the opposed lateral side edges rearward of the shaft axis and forward of the center of pressure.

* * * * *